United States Patent [19]

McCorkle et al.

[11] 3,964,716

[45] June 22, 1976

[54] WOOD PROCESSING UNIT FOR REDUCING AIR POLLUTION

[75] Inventors: Alfred S. McCorkle, Kirkland, Wash.; Charles L. Hoar, Portland, Oreg.

[73] Assignee: McKorkle Children Trust, Kirkland, Wash.

[22] Filed: Sept. 3, 1970

[21] Appl. No.: 69,268

[52] U.S. Cl. ..... 241/28; 241/29; 241/152 A 241/278 A

[51] Int. Cl. ..... B02C 19/12

[58] Field of Search ..... 241/28, 29, 68, 101 M, 241/278 A, 299, 79, 152 R, 152 A, 157; 144/3 D, 4, 162 R, 172

[56] References Cited

UNITED STATES PATENTS

| | | | |
|---|---|---|---|
| 136,571 | 3/1873 | Wasson | 241/68 |
| 264,167 | 9/1882 | Jones | 241/28 |
| 438,633 | 10/1890 | Marshall | 241/278 A |
| 1,277,631 | 9/1918 | Mitchell | 241/278 R X |
| 1,313,709 | 8/1919 | McKoy | 241/101 M |
| 1,493,382 | 5/1924 | Priem | 241/28 |
| 2,901,188 | 8/1959 | Welfers | 241/299 X |
| 2,981,485 | 4/1961 | Mainone | 241/101 M |
| 3,249,310 | 5/1966 | Willems | 241/29 |
| 3,254,847 | 6/1966 | Brandts | 241/28 X |
| 3,372,878 | 3/1968 | Verdier | 241/29 X |
| 3,457,978 | 7/1969 | Ahlstedt | 241/68 X |
| 3,461,931 | 8/1969 | Wexell | 144/162 R |
| 3,527,417 | 9/1970 | Tompsett | 241/101 M |
| 3,545,692 | 12/1970 | Burkett | 241/101 M |
| 3,554,453 | 1/1971 | Thale | 241/28 |
| 3,557,263 | 1/1971 | Marra | 241/28 X |
| 3,559,898 | 2/1971 | Rinke | 241/101 M |
| 3,587,981 | 6/1971 | Unterstenhoefer | 241/29 |
| 3,650,480 | 3/1972 | Van Etten | 241/28 |
| R4,418 | 6/1871 | Voelter | 241/29 X |

FOREIGN PATENTS OR APPLICATIONS

| | | | |
|---|---|---|---|
| 509,880 | 7/1939 | United Kingdom | 144/4 |

*Primary Examiner*—Granville Y. Custer, Jr.
*Attorney, Agent, or Firm*—Thomas W. Secrest

[57] ABSTRACT

This invention is directed to an apparatus and method for reducing the size of a material so as to make it possible to more readily and easily handle said material and, concurrently, to make said material into a useful product.

An example of this is a treatment of wood remaining in a cutover forest. The wood may be in the form of stumps, broken logs, branches, limbs and the like. This wood may be processed so as to reduce the size of the wood. The wood which has been reduced in size is left on the ground to rot. An alternative to this is to reduce the size of the wood so as to make it more easily and readily handled and then to haul this reduced size wood to a processing area or processing plant for further processing.

28 Claims, 10 Drawing Figures

INVENTOR
Alfred S. McCorkle
BY Charles L. Sloan
TW Secrest

INVENTOR
Alfred S. McCorkle
BY
Charles T. Hoar
TW Secrest

INVENTOR
Alfred J. McClarkle
BY
Charles F. Warner
T W Secrest

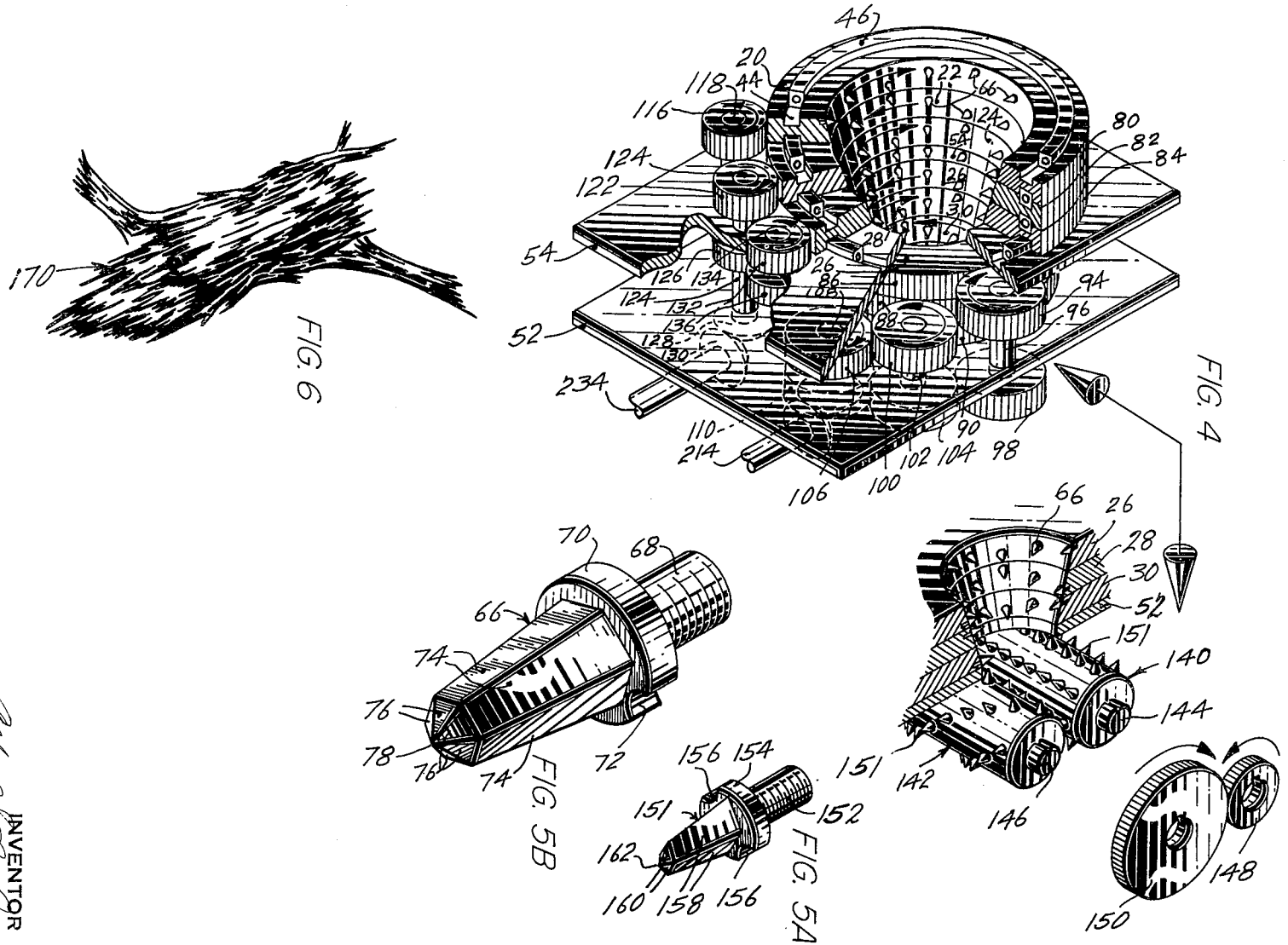
INVENTOR
Alfred J. McCorkle
BY
Charles L. Moore
JW Secrest

INVENTOR
Alfred S. Mielonkle
BY
Jerome Spiro
TW Secrest

INVENTOR
Alfred J. McClarkle
BY
Sherlock & Son
TW Servost

INVENTOR
Alfred S. McCorkle
BY
Charles L. Sloan
TW Secrest

WOOD PROCESSING UNIT FOR REDUCING AIR POLLUTION

In a forest there are blow down trees which cannot be salvaged, felled trees during the logging operation which have broken and cannot be salvaged, limbs and branches and remaining stumps. In addition to these there is the cull log. A cull log is a log which is not merchantable. Quite often, a cull log is a log which is large and has a long length. The cull log may have a diameter of 4 or 5 or 6 feet, and, in exceptional cases, a diameter larger than 6 feet. Further, the cull log may have a length up to 80 feet. The handling of a log of this size is difficult. If a log of this size is allowed to remain in the cutover land a tree cannot take root and grow where the log lies. A log of this size hinders the reforestation of the cutover land and therefore hinders the next regenerative cycle of tree growing. For example, in the Pacific Northwest, the cycle of tree growing is approximately 60 to 80 years. It is in this cycle of tree growing that the maximum amount of wood is produced per unit of time. A cull log having a diameter of at least 4 or 5 feet will not rot in less than approximately 50 years. In this time period the regenerative cycle of tree growing has started and is almost complete. Where the cull log has lain on the ground, a new tree or trees cannot take root and grow. This land or ground is rendered useless and will not produce trees in this regenerative growth cycle. Unfortunately, in exceptional circumstances, the land area covered by these old, rotten logs will exceed 35 percent of the available land area for growing trees. These comments are equally applicable to stumps in the ground. Where there is a stump in the ground there is no possibility of a new tree taking root and growing. A stump in the ground takes longer to rot than a cull log lying on top of the ground. The reason for this is the high natural resin concentration in the stump which reduces the possibility of rotting. If a stump be 4 feet or 5 feet or 6 feet or even 8 or 9 feet in diameter, the possibility of rotting in 100 years is remote. As a result, in the next regenerative tree cycle, trees will not take root and will not grow where there is a stump.

After an area has been logged the area is burned so as to reduce the possibility of a later non-controllable fire. In order to realize maximum productive area for growing the next crop of trees, it is advisable to remove the stumps from the ground and to bunch together the logs, stumps, branches and limbs and to burn as much as possible. In a highly forested region, there will be many bunched logs, stumps, trees and branches. For example, there may be a crane at a landing site for bunching the logs and stumps and there may be many of these bunches. This necessitates a crane and a crane operator. Further, there is a fire tender who oversees the burning of these bunches and who adds fuel such as gasoline, kerosene and diesel oil and even old rubber tires and other burnable material. In addition, there are two or three assistants who are continually scouring the country side to extinguish small fires which are set near these bunches by sparks flying from the bunches. In all, there may be five or six or seven men working to burn these bunches of logs, stumps, limbs and branches in addition to the heavy machinery involved. As an inherent result of burning these bunches or trash accumulation, there is produced a thick blue smoke due to the incomplete combustion of the wood and diesel oil. The wood comprises cellulose, lignin, resins and the like. In the burning of the wood and the diesel oil and other fuel, there is produced solid particulates in the smoke, water, carbon dioxide, carbon monoxide, and pyrolysis products of the burning of the wood. Many of these pyrolysis products are carbon products. Except for the carbon dioxide, and the water, resulting from the burning of the wood, these other products are pollutants in the air. In the burning of these bunches and trash accumulation the time required is a minimum of approximately 2 days with observers being present all of the time to reduce or lessen the possibility of starting a forest fire. In the Pacific Northwest, the average airborne pollutant resulting from the burning of trash accumulation on cutover land is approximately 200 tons per acre of cutover land. In certain instances, in the slash burning of cutover land the inventor has seen smoke clouds in the sky and which smoke clouds have been so heavy and so thick and voluminous that the inventor has thought that there was a forest fore. As a result, the inventor has made inquiry as to the location of the forest fire and has been informed that there was no forest fire but merely the slash burning of trash accumulation resulting from a logging operation.

From having worked as a logger and having had to burn trash accumulation resulting from a logging operation, we have invented an apparatus and method for reducing the trash accumulation and making it possible to economically take the cull logs, broken logs, stumps, limbs and branches and remove these from the land so as to make it possible to have more available land for growing the next regenerative cycle of trees. The apparatus and method make it possible to take a large cull log or a large stump and in 15 minutes, reduce the size of this large cull log or large stump to a size which can be readily handled. For example, a large cull log or a large stump, instead of being allowed to remain on the ground and hinder the growth of trees in the next regenerative cycle, we handle and process these logs and stumps so as to reduce the size and make it possible to readily dispose of the reduced log and stump over the ground to act as a mulch and a fertilizer or, preferably, to take the reduced log and stump and transport this reduced log and stump to a central processing plant and further process it into a more useful product. The apparatus we employ may be a mobile apparatus for travelling to the cutover land and processing the logs and stumps on the cutover land or it may be a stationary apparatus so that the stumps and logs are brought to it and then processed at a central location.

Accordingly, an object of this invention is to provide an apparatus and method to reduce the cost of land clearing; to provide an apparatus and method for conserving resources in that material left in cutover land is processed to make a useful material for mulching purposes and for increasing the humus in the soil or to make a material which can be still further processed and increased in economic value; an additional object is to provide an apparatus and method to conserve resources in regard to making more land area available for growing trees in the next regenerative growth cycle; to provide an apparatus and method for reducing pollution, both solid and gaseous, which result as a by-product in cleaning trash accumulation resulting from a logging operation; to provide an apparatus and process to lessen the cost of disposing of waste material on cleared land and thereby reduce the cost of land clearing; to provide a low cost method for clearing land for housing developments, reforestation and tree planting for the next regenerative cycle, the clearing of farm land and the like; and, to provide a method and apparatus for abrading, tearing, shredding, crushing and dividing a piece of wood into a fibrous wood article.

These and other important objects and advantages will be more particularly brought forth upon reference to the accompanying drawings, the detailed specification and disclosure of the invention, and the appended claims.

In the drawings:

FIG. 4 is a fragmentary perspective view looking at the rotors, the shredding means on the inner surfaces of the rotors, the gears on the outside of the rotors and the drive gears for rotating said rotors;

FIG. 5A is a perspective view of an shredding unit on the out-feed shredders located below the rotors;

FIG. 5B is a perspective view looking at the shredding means on the inner surface of the rotors;

FIG. 6 is a perspective view looking at the shredded fibers produced by this processing unit;

Figure 2:
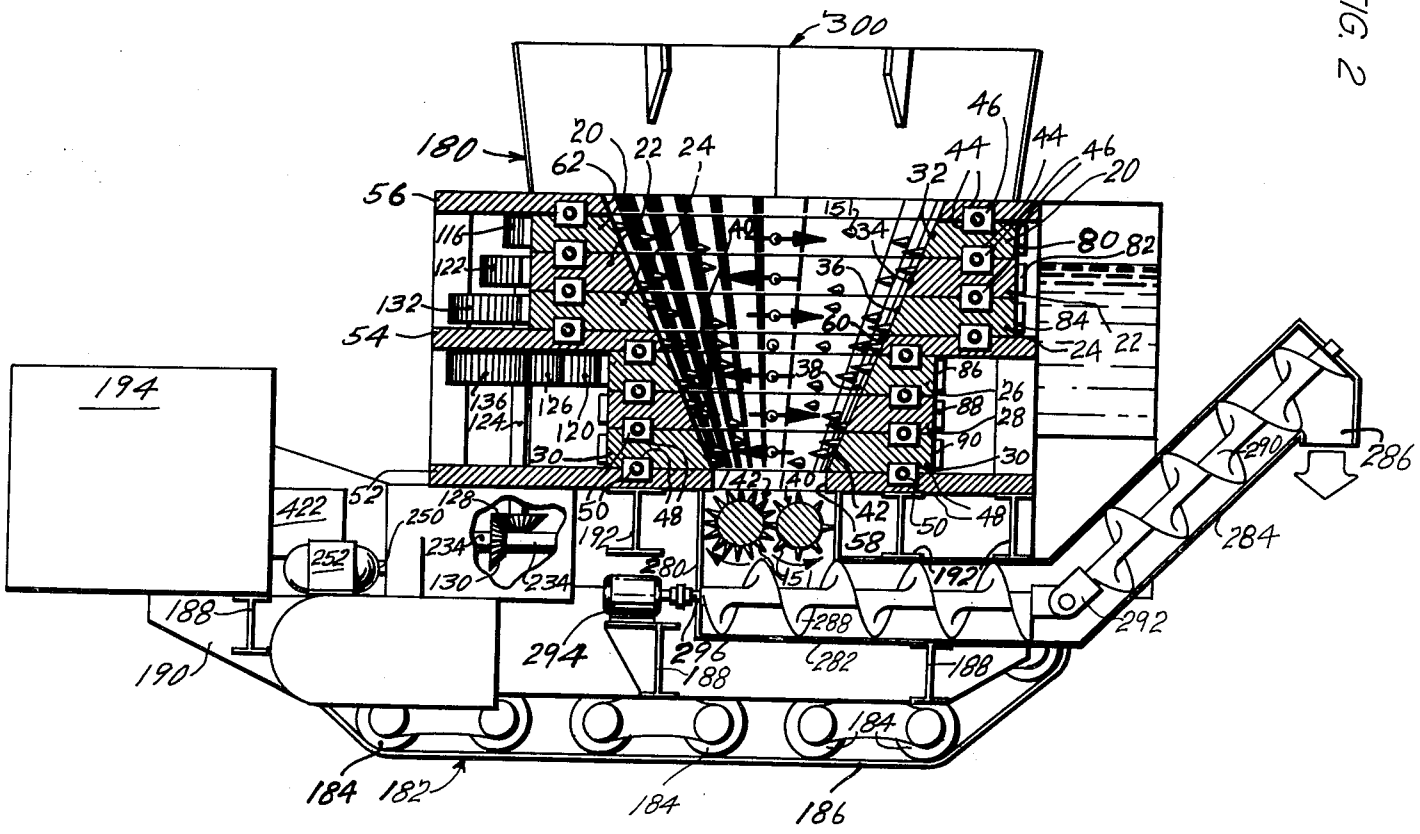
FIG. 2 is a longitudinal vertical cross-sectional view illustrating a mobile processing unit having rotors with shredding means on the inner surface of the rotors for reducing the size of large material such as stumps and logs, the shredder is located below the outlet of the rotors, and an augur for conveying the shredded wood away from the shredders and the rotors.

With reference to the drawings and, in particular, FIGS. 2 and 4 it is seen that there are a plurality of rotors in a vertical relationship with respect to each other. There is an upper rotor 20, a next lower rotor 22, a next lower rotor 24, a next lower rotor 26, a next lower rotor 28 and the bottom rotor 30. Each of these rotors has a central passageway. The rotor 20 has a central passageway 32; the rotor 22 has a central passageway 34; the rotor 24 has a central passageway 36; the rotor 26 has a central passageway 38; the rotor 28 has a central passageway 40 and the rotor 30 has a central passageway 42. The central passageways 32, 34, 36, 38, 40 and 42 are in the configuration of a frustrum of a cone and lead from one rotor to the next rotor.

Each of the rotors 20, 22 and 24 in their upper and their lower faces has a bearing groove 44. The bearing grooves 44 in these rotors 20, 22 and 24 are of the same diameter and therefore will accept the same bearing 46.

The rotors 26, 28 and 30, in both their upper and their lower faces, have a bearing groove 48. The bearing grooves 48 are of the same diameter for receiving the bearing 50. In FIG. 2 it is seen that there is a lower positioning plate 52, an intermediate positioning plate 54 and an upper positioning plate 56. The lower positioning plate 52 is positioned below the rotor 30 and has a bearing groove 48 for receiving the bearing 50. The intermediate positioning plate 54 is positioned between the rotor 26 and the rotor 24 and has a bearing groove 48 for receiving the bearing 50 and has a bearing groove 44 for receiving the bearing 46. The upper plate 56 is positioned above the upper rotor 20 and has a bearing groove 44 for receiving the bearing 46.

The positioning plates 52, 54 and 56 are attached to the framework of this processing unit and position the rotors 20, 22, 24, 26, 28 and 30. A rock or another solid, hard object may be introduced into the passageways of the rotors and create tremendous pressures to separate the rotors. These plate 52, 54 and 56 position the rotors under these tremendous pressures. The plate 52 has a central passageway 58 below the passageway 42 in the rotor 30. The plate 54 has a central passageway 60 below the passageway 36 in the rotor 24 and above the passageway 38 in the rotor 26. The plate 56 has a passageway 62 above the passageway 32 in the rotor 20.

In the passageways of these rotors there is positioned a tooth 66. The tooth 66 is more completely illustrated in FIG. 5B wherein it is seen that there is a threaded shank 68, a collar 70 having grooves 72, a main body portion having six faces 74 and a tip having six faces 76 which meet at an apex or a point 78. The rotors adjacent to the surface of the inner passageway are drilled and tapped to receive the threaded shank 68 of the tooth 66. The grooves 72 receive a bolt which is also screwed into the rotors and which bolt helps to firmly position the tooth 66.

The rotor 20 has external gear teeth 80; the rotor 22 has external gear teeth 82; the rotor 24 has external gear teeth 84; the rotor 26 has external gear teeth 86; the rotor 28 has external gear teeth 88; and, the rotor 30 has external gear teeth 90.

A gear 94 meshes with the gear teeth 86 of the rotor 26. The gear 94 is mounted on a shaft 96. The shaft 96 extends through the bottom plate 52. On the lower end of the shaft 96 there is a gear 98.

A gear 100 meshes with the gear teeth 88 on the rotor 28. The gear 100 is mounted on a shaft 102. The shaft 102 passes through an opening in the bottom plate 52. On the lower end of the shaft 102 there is a gear 104.

A gear 106 meshes with the gear teeth 90 on the rotor 30. The gear 106 is mounted on a shaft 108. The shaft 108 passes through a passageway in the bottom plate 52. On the lower part of the shaft 108 there is mounted a gear 110.

On the lower end of the shaft 108 there is a bevel gear 112. The bevel gear 112 is driven by another bevel gear 114.

The gear 110 drives the gear 104. The gear 104 drives the gear 98.

In FIG. 4 it is seen that the gear 106 rotates in a clockwise direction so as to rotate the rotor 30 in a counterclockwise direction. The gear 100 rotates in a counterclockwise direction so as to rotate the rotor 28 in a clockwise direction. The gear 94 rotates in a clockwise direction so as to rotate the rotor 26 in a counterclockwise direction.

A gear 116 meshes with the gear teeth 80 on the rotor 20. The gear 116 is mounted on a shaft 118. The shaft 118 extends through a passageway in the intermediate plate 54. On the lower end of the shaft 118 there is a gear 120 (see FIG. 2). A gear 122 meshes with the gear teeth 82 of the rotor 22. The gear 122 is mounted on a shaft 124. The shaft 124 extends through a passageway in the intermediate plate 54. On the intermediate part of the shaft 124 there is a gear 126. Also, the shaft 124 extends through a passageway in the bottom plate 52. On the lower end of the shaft 124 there is a bevel gear 128. The bevel gear 128 meshes with and is driven by a bevel gear 130.

A gear 132 meshes with the gear teeth 84 of the rotor 24. The gear 132 is mounted on a shaft 134. The shaft 134 extends through a passageway in the intermediate plate 54. On the lower end of the shaft 134 there is a gear 136.

The gear 126 drives the gear 120 and also drives the gear 136.

In FIG. 4 it is seen that the gear 116 rotates in a counterclockwise direction so as to rotate the rotor 20 in a clockwise direction. The gear 122 rotates in a clockwise direction so as to rotate the rotor 22 in a counterclockwise direction. The gear 132 rotates in a counterclockwise direction so as to rotate the rotor 24 in a clockwise direction.

The bottom plate 52 has the opening or passageway 58. The passageway 58 may be considered to be the throat. There is positioned below the throat 58 two rollers 140 and 142.

The roller 140 is mounted on a shaft 144 and the roller 142 is mounted on the shaft 146. There is a small gear 148 mounted on the end of the shaft 144 and there is a large gear 150 mounted on the end of the shaft 146. The gear 148 is in a driving relationship with the gear 150. The gear 148 rotates at a higher angular revolution than the gear 150. Therefore, the roller 140 rotates at a higher angular velocity than the roller 142.

On the rollers 140 and 142 there are mounted the teeth 151 having a threaded shank 152, a collar 154 with recesses 156, a four-sided base 158 which extends into four surfaces 160 which come together at a point 162. In the rollers 140 and 142 there are drilled holes which are tapped. The teeth 140 can be screwed into these tapped holes. Bolts may be screwed into the rollers and into the recesses 156 for definitely and firmly positioning the teeth 151 in these rollers. In FIG. 4 it is seen that the tooth pattern of the teeth 151 on the roller 140 is different than the tooth pattern of the teeth 151 on the roller 142. The teeth 151 on the roller 140 mesh with the teeth 151 on the roller 142.

With the difference in the velocity of angular rotation of the rollers 140 and 142 and the teeth 150 on these rollers the rollers tend to have a shreading action on any material which passes through the throat 58.

The approximate length of the teeth 66 including the collar and the bases 74, 76 and the point 78 may be approximately 6 inches in length.

The approximate length of the teeth 151 including the collar 154, the bases 158 and 160 and the point 162 may be approximately 4 inches in length.

The passageway 62 in the top plate 56 may have a diameter of approximately 9 feet. The throat 58 may have a diameter of approximately 3 feet.

In operation a piece of wood such as a tree stump, a broken log or the remains of a log, a limb or the like may be introduced into the passageways of the rotor. The top three rotors 20, 22 and 24 may have an angular velocity of approximately 50 revolutions per minute. The bottom three rotors 26, 28 and 30 may have an angular velocity of approximately 100 revolutions per minute. The reader is reminded that the adjacent rotors are rotating in opposite directions, i. e., some of the rotors are rotating in a clockwise direction while the adjacent rotors are rotating in a counterclockwise direction. The difference in the direction of rotation of the rotors and the difference in the angular velocity of the rotors, coupled with the teeth 66 tend to shear and disintegrate the wood introduced into the passageways of these rotors. As wood is a fibrous material the wood is shreaded into fibrous bundles. Now, the rollers 140 and 142, positioned below the throat 58, rotate in different directions and at different angular velocities. For example, the roller 140 may rotate at an angular velocity of approximately 500 revolutions per minute while the roller 142 may rotate at an angular velocity of approximately 250 revolutions per minute. With the rotation of these rollers at different velocities and also with the teeth 151 on the outer surfaces of these rollers the teeth tend to have a further shearing action on the bundles of fibers so as to produce a fibrous shreaded product 170, see FIG. 6.

This wood processing unit 180 can be mounted on a stationary base or can be mounted on a mobile base. In FIG. 2 it is seen that the wood processing unit 180 is mounted on a mobile truck vehicle base 182. The base 182 may be a converted surplus track military vehicle such as an M-6, M-8, or another suitable track military vehicle. Also, the mobile base 182 may be specially constructed for supporting and conveying the wood processing unit 180.

The mobile base 182 has a chaise, rollers 184 for the endless tracks 186. The chaise has lateral reinforcing I-beams 188 and an extended deck 190. There is a superstructure also having lateral I-beams 192. In FIG. 2 it is seen that the lower positioning plate 52 is positioned on the lateral I-beam 192. On the extended deck 190 there is a motor housing 194.

Figure 1:
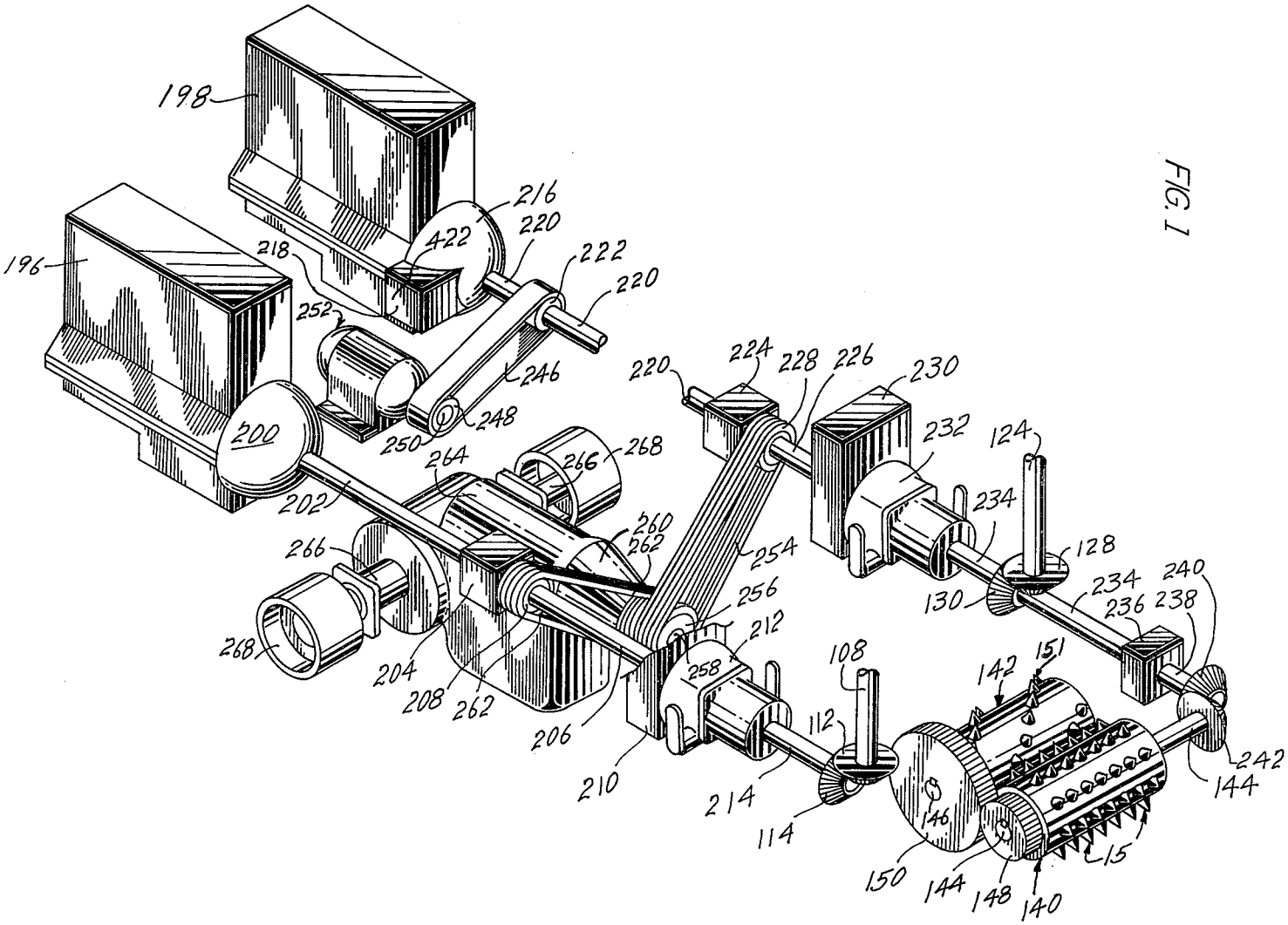
FIG. 1 is a fragmentary, schematic illustration of the prime movers, the transmission and differential, in a mobile processing unit and illustrates the shredders for shredding wood which has been reduced in size.

In FIG. 1 there is a perspective and schematic illustration of the main components and the main power train for driving the rotors and for driving the rollers 140 and 142.

In the motor housing 194 there are two motors, 196 and 198. The motors 196 and 198 may be diesel motors and each has a horse power rating of about 700. The motor 196 on its output shaft connects with a torque converter 200. The torque converter 200 has an output shaft 202 which connects with a clutch 204. The clutch 204 connects with an output shaft 206. On the output shaft 206 there is a pulley 208. The shaft 206 connects with the speed reducing and reversing mechanism 210. The speed reducer and reversing mechanism 210 connects with the clutch 212. The clutch 212 connects with the shaft 214. The shaft 214 connects with the bevel gear 114 and the bevel gear 114 connects with the bevel gear 112. As previously stated the bevel gear 112 connects with the shaft 108. On the shaft 108 are gears 106 and 110.

The motor 198 connects with the torque converter 216. The torque converter 217 connects with a power take-off unit 218. Also, the torque converter 216 connects with a shaft 220. On the shaft 220 is the pulley 222. The shaft 220 connects with the clutch 224. The clutch 224 connects with the shaft 226. On the shaft 226 is a pulley 228. The shaft 226 connects with a speed reducing and reversing mechanism 230. The speed reducer and reversing mechanism 230 connects with a clutch 232. The clutch 232 connects with a shaft 234. On the shaft 234 is the bevel gear 130. The bevel gear 130 meshes with the bevel gear 128. The bevel gear 128 is on the lower end of the shaft 124. On the shaft 124 are gears 126 and 122. The shaft 234 connects with the reversing gear box 236. The reversing gear box 236 connects with the shaft 238. On the end of the shaft 238 is a bevel gear 240. The bevel gear 240 meshes with the bevel gear 242. The bevel gear 242 is mounted on the shaft 144. As is recalled there is mounted on the shaft 144 the roller 140. On the other end of the shaft 144 there is the gear 148. The gear 148 meshes with the gear 150. The gear 150 is on the end of the shaft 146. On the shaft 146 is the roller 142. In this manner the rollers 140 and 142 are caused to rotate at different angular velocities.

The pulley 222 on the shaft 220 drives a belt 246. The belt 246 runs around a pulley 248 on the shaft 250. The shaft 250 is the entrance shaft to the generator 252. In this manner the generator 252 is driven so as to generate electricity for the unit.

On the shaft 226 there is the pulley 228. The pulley 228 connects with the belts 254. The belts 254 pass around the pulleys 256. The pulleys 256 are mounted on the input shaft 258 to the transmission 260.

On the shaft 206 there is the pulley 208. The belts 262 pass around the pulleys 208 and around the pulleys 256 on the input shaft 258. The transmission 260 connects with the differential 264. The differential 264 connects with the final drives 266. The final drives 266 connect with the drive sprockets 268 for driving the endless tracks 186. In this manner the two motors 196 and 198 through the drive shafts 226 and 206 and the belts 250 and 262 drive the transmission 260, the differential 264 and the final drives 266 and thereby the mobile track base 182.

There is positioned below the outlet opening 58 in the lower positioning plate 52 a housing 280. The housing 280 houses the rollers 140 and 142. In FIG. 2 it is seen that the housing 280 is substantially vertical. Then, the housing 280 connects with the housing 282 which is substantially a horizontal tube. The housing 282 connects with a housing 284 which is substantially a tube. The tube 284 is approximately at an angle of 45° with the tube 282. On the end of the tube 284 there is an outlet tube 286.

In the tube or housing 282 there is an auger 288. In the tube or housing 284 there is an auger 290. The augers 288 and 290 are connected by means of a universal joint 292.

A motor 294 is mounted on a lateral I-beam 188. The motor 294 connects with the input shaft 296 of the auger 288 so as to drive the auger 288 and to drive the auger 290.

The product dropping down from the rollers 140 and 142 is augered by the auger 288 through the housing 282 and is augered by the auger 290 through the housing 294 so as to pass through the outlet tube 286.

There is positioned above the upper positioning plate 56 and in a circumscribing relationship to the opening 62 of said plate 66 a hopper 300.

Figure 7:
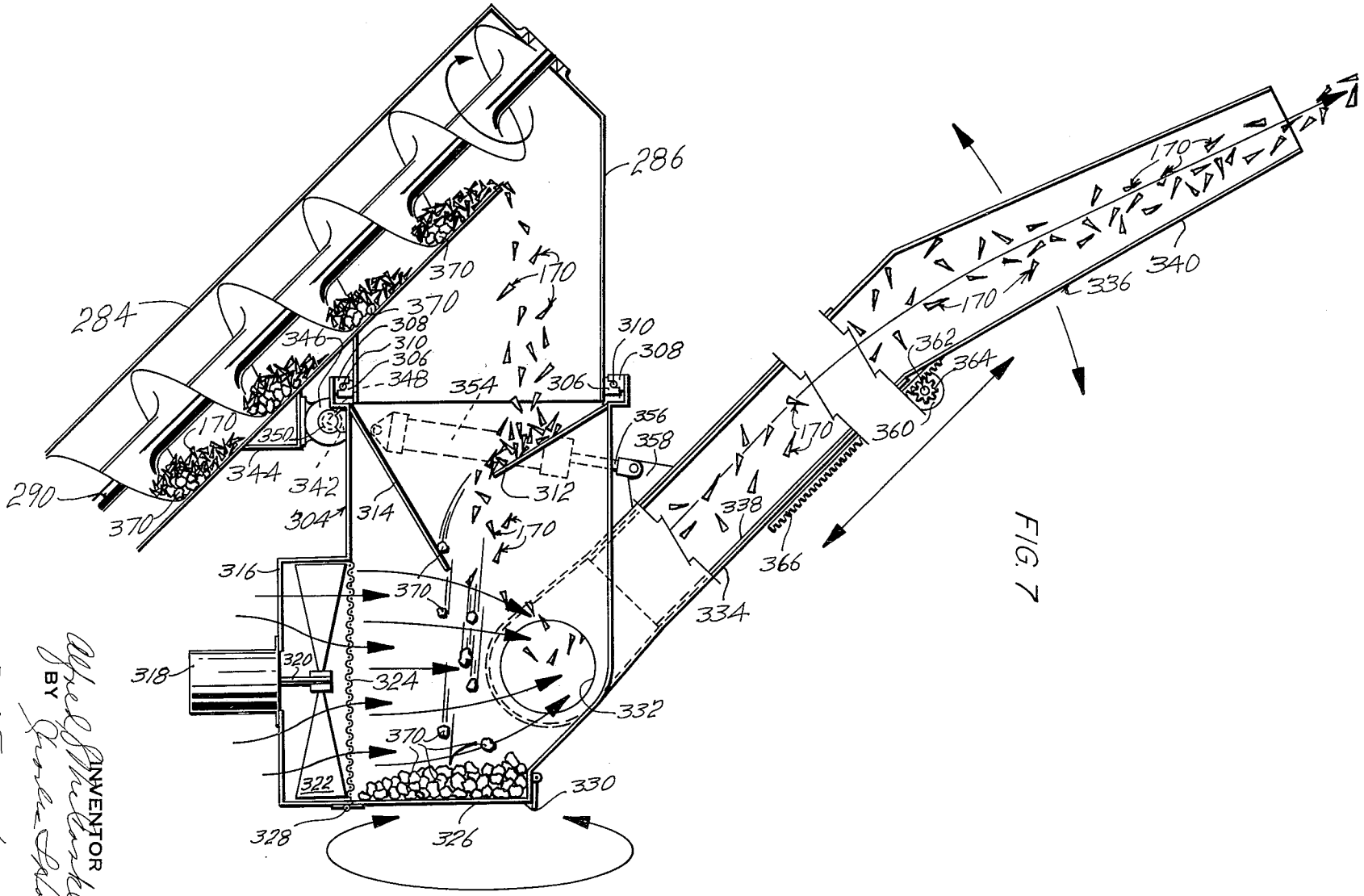
FIG. 7 is a fragmentary view looking at the augur for conveying shredded wood and extraneous materials such as dirt and rocks to a hopper whereby the shredded wood is separated from the rocks, and a pneumatic conveyor for conveying or blowing the shredded wood away from the hopper.

In FIG. 7 it is seen that on the end of the housing 284 and the outlet housing 286 that there is a hopper 304.

On the lower end of the outlet housing 286 there is a bearing ring 306. The hopper 304 on its upper end has a bearing ring 308. A bearing 310 is positioned between the bearing rings 306 and 308. In the hopper 304 there is a baffle 312. Also, in the hopper 304 there is a baffle 314. The hopper 304 has a lower side housing 316. The lower side housing 316 is open so as to allow the passage of air. There is mounted on the lower side housing 316 a motor 318 having an output shaft 320. On the output shaft 320 there is a fan blade 322. Between the fan blade 322 and the lower part of the hopper 304 there is a screen 324. On the lower part of the hopper 304 there is mounted a door 326. The door 326 is mounted by means of a hinge 328 to the lower part of the housing 316. A catch 330 locks the door 326 in position, until an operator desires to open the door 326 to allow accumulated material to drop out of the hopper 304.

The hopper 304 on one side has an opening 332. Tubular housing 344 connects with the hopper 304 around said opening 332. There is a second housing 336 having a tubular housing portion 338 which fits in a telescoping relationship with the tubular housing 334. The housing 336 on its upper end has another tubular housing 340 which connects with the tubular housing 338.

There is positioned on the upper part of the hopper 304 a ring gear 342. The arc of the ring gear 342 is approximately 180 to 200°. The ring gear 342 faces the housing 284.

There is positioned on the housing 284, and that part of the housing 284 facing the hopper 304 and the ring gear 342, a bracket 344. The bracket 344 supports or carries a hydraulic motor 346. The hydraulic motor 346 has an output shaft 348. On the output shaft 348 there is a gear 350. The gear 350 meshes with the ring gear 342. As is readily apparent the rotation of the output shaft 348 and the gear 350 rotates the hopper 304 and the output housing 336.

There is mounted on the hopper 304 a hydraulic cylinder 354. The hydraulic cylinder 354 has a ram 356. There is mounted on the housing 334 a bracket 358. The hydraulic ram 356 connects with the bracket 358. Also, the lower end of the housing 334 is in a revolving or rotating relationship with the outlet 332 of the hopper 304. By extending and retracting the ram 356 it is possible to vary the position of the housing 334 and the housing 336. In other words, the elevation of the output housing 340 may be varied by retracting and extending the hydraulic ram 356.

It is seen that there is attached to the outer end of the housing 334 a hydraulic motor 360. The hydraulic motor 360 has an output shaft 362 and a gear 364 on the output shaft 362. Again, the hydraulic motor 360 is on the outer end of the housing 334. There connects with the housing 340 a rack 366. The rack 366 engages the gear 364. It is possible by actuating the hydraulic motor 360 to rotate the output shaft 364 and the gear 362 so as to vary the position of the housing 336 with respect to the housing 334 and thereby vary the elevation of the output housing 340.

Now, in operation with the grinding of wood, stumps branches and logs, there is always the possibility of gravel, dirt, and sand being mixed in with the wood. This is especially so with respect to stumps. The roots of the stumps are quite often partially or totally encased by dirt and rocks. With the grinding of the wood into the fibrous material 170, see FIG. 6, the rocks are partially ground and the dirt passes through the rotors and the rollers 140 and 142. The auger 290 augers the wood fiber, the rocks, dirt and sand to the outlet housing 286. The fibrous wood, rocks, dirt and sand fall into the housing 286 and hit the baffle 312. The fibrous material slides off of the baffle 312 and into the airstream created by the fan 318 and the fan blades 322. The fibrous material is relatively light in weight and is blown out of the hopper 304, through the opening 322 and into the housing 334, 338 and 340. Also, the fibrous wood 170 is blown out of the hopper 304 into some collecting means such as a truckbed, bunker, or other suitable collecting means. The rocks 370 collect in the bottom of the hopper 304 and on the door 326. In addition to the rocks, there may collect dirt and sand. The rocks 370, dirt and sand are, generally, not blown out of the hopper 304, through an opening 332, and the housing 334, 338 and 340 and out of the housing 340. These rocks 370, dirt and sand may be lead out of the hopper 304 by loosening the catch 330 and allowing the door 326 to rotate downwardly to dump the rocks, dirt and sand.

In FIG. 2 it is seen that the outlet housing 286 dumps the material directly downwardly. With the mobile base 182 the operator may decide to dump the fibrous material, rocks, dirt and sand directly onto the ground. Or, there may be a truck or mobile means having a collecting bunker for collecting the fibrous material 170, rocks, dirt and sand and then transporting the fibrous material and other extraneous material to another processing plant for separating the fibrous material 170 from the rocks 370 and other extraneous material so as to further process and convert the fibrous material into other useful products.

Figure 9:
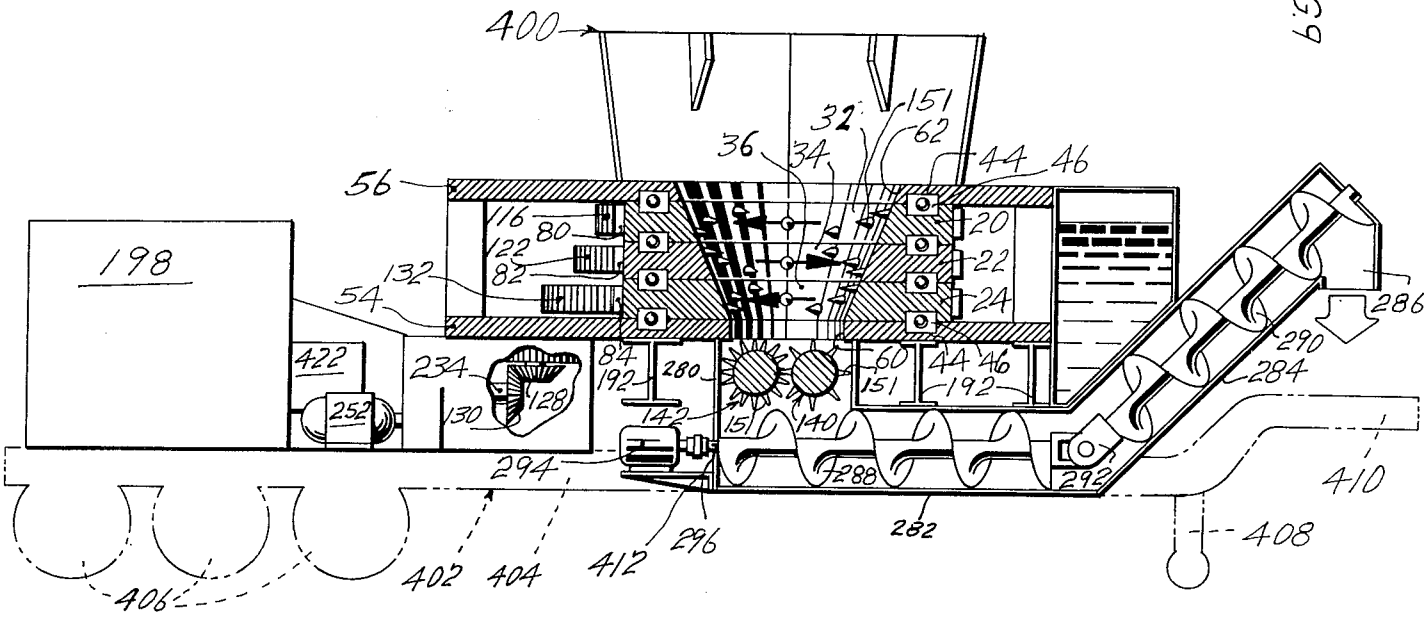

In FIG. 9 there is illustrated a wood processing unit 400 on a low-boy trailer 402. The low-boy trailer 402 comprises a bed 404 and rear-support wheels 406. On the forepart of the low-boy trailer 402 there is a stand support 408. On the front of the low-boy trailer 402 there is a gooseneck 410.

The wood processing unit 400 comprises essentially the same components as the wood processing unit 180 less the components for driving the lower rotors 26, 28 and 30. This means that the wood processing unit 400 does not have the components, see FIG. 1, motor 196, torque converter 200, drive line 202, differential 264, transmission 260, clutch 204, belts 262, shaft 206, shaft 202, speed reducer 210, clutch 212, shaft 214, bevel gears 112 and 114 and shaft 108.

The unit 180 comprises an upper plate 56, a rotor 20, a rotor 22 and a rotor 24. There is a lower plate 54. In this regard see FIG. 2.

The upper plate 56 has a passageway 62. Each of the rotors has a central passageway, exempli gratia, the rotor 20 has a central passageway 32; the rotor 22 has a central passageway 34; and, the rotor 24 has a central passageway 36. The bottom plate 54 has an outlet passageway 60.

The upper plate 56 in its lower surface has bearing groove 44. Each of the rotors 20, 22 and 24 in their upper and lower faces has a bearing groove 44. The lower plate 54 has a bearing groove 44. The bearing grooves 44 in the plates 56 and 54 and in the rotors 20, 22 and 24 are of the same diameter and therefore will accept the same bearing 46. In FIG. 9 it is seen that each of the passageways 62, 32, 34 and 36 are in the configuration of a frustrum of a cone and become successively smaller in diameter upon going from the upper plate 56 to the lower plate 54.

There is positioned below the outlet opening 60 a roller 142 and a roller 140. The roller 142 has teeth 151 in a spiral pattern and the roller 140 has teeth 151 in a symmetrical non-spiral pattern. The teeth 151 on the roller 142 mesh with the teeth 151 on the roller 140.

The rotors 20, 22 and 24 have external gear teeth. The rotor 20 has external gear teeth 80. The rotor 22 has external gear teeth 82. The rotor 24 has external gear teeth 84.

A gear 116 meshes with the gear teeth 80 on the rotor 20. The gear 116 is mounted on a shaft 118. The shaft 118 extends through a passageway in the lower plate 54. On the lower end of the shaft 118 there is a gear 120. A gear 122 meshes with the gear teeth 82 of the rotor 22. The gear 122 on mounted on a shaft 124. The shaft 124 extends through a passageway in the lower plate 54. On the intermediate part of the shaft 124 there is a gear 126. On the lower end of the shaft 124 there is a bevel gear 128. The bevel gear 128 meshes with and is driven by a bevel gear 130. A gear 132 meshes with the gear teeth 84 of the rotor 24. The gear 132 is mounted on a shaft 134. The shaft 134 extends through a passageway in the intermediate plate 54. On the lower end of the shaft 134 there is a gear 136. The gear 126 drives a gear 120 and also drives a gear 136.

The gear 116 rotates in a counterclockwise direction so as to rotate the rotor 20 in a clockwise direction. The gear 122 rotates in a clockwise direction so as to rotate the rotor 22 in a counterclockwise direction. The gear 132 rotates in a counterclockwise direction so as to rotate the rotor 24 in a clockwise direction.

The lower plate 54 is mounted on lateral I-beams 192.

There is positioned below the outlet opening 60 in the lower plate 54 a housing 280. The housing 280 houses the rollers 140 and 142. In FIG. 9 it is seen that the housing 280 is substantially vertical. Then, the housing 280 connects with the housing 282 which is substantially a horizontal tube. The housing 282 connects with the housing 284 which is substantially a tube. The tube 284 is approximately at an angle of 45° with the tube 282. On the end of the tube 284 there is an outlet tube 286. In the tube or housing 282 there is an auger 288. In the tube or housing 284 there is an auger 290. The augers 288 and 290 are connected by means of a universal joint 292. A motor 294 is mounted on a support bracket 412. The support bracket 412 is mounted on the lower part of the housing 280. The motor 294 connects with the input shaft 296 to the auger 288 so as to drive the auger 288 to drive the auger 290. The product dropping from the rollers 140 and 142 is augered by the auger 288 through the housing 282 and is augered by the auger 290 through the housing 294 so as to pass through the outlet tube 286.

There is positioned above the upper housing plate 56 and in a circumscribing relationship to the opening 62 of said plate a hopper 300.

The power train for powering the wood processing unit 400 comprises only the upper components of FIG. 1. More particularly, there is a motor 198, a torque converter 216, and a power take-off unit 218. The torque converter 216 has an output shaft 220. On the output shaft 220 there is a pulley 222. In FIG. 9 it is seen that there is a generator 252 mounted on the base 404 of the low-boy trailer 402. The generator 252 has an input shaft 250 and a pulley 248 mounted on the input shaft 250. A belt 246 runs around the pulleys 222 and 250. The shaft 220 connects with a speed reducer and reversing mechanism 230. 230 connects with the clutch 232. The clutch 232 connects with the shaft 234. On the shaft 234 there is a bevel gear 130. There is positioned above the shaft 234 and the bevel gear 130 a shaft 124. On the lower end of the shaft 124 there is a bevel gear 128. The shaft 234 connects with a reversing gear box 236. The box 236 has an output shaft 238. On the end of the output shaft 238 there is a bevel gear 240. A bevel gear 242 meshes with the bevel gear 240. The bevel gear 242 is mounted on the shaft 144. The shaft 144 is a drive shaft leading to the roller 140. On the output end of the shaft 144 there is mounted a gear 148. The gear 148 meshes with the gear 150. The gear 150 is mounted on the shaft 146. The shaft 146 is the shaft to the roller 142.

From the foregoing it is seen that there has been disclosed and described a wood processing unit 400 which is mounted on a low-boy trailer 402 and which wood processing unit 400 comprises three rotors 20, 22 and 24 having teeth 66 for carrying and shredding the woody material into fibrous material 170 as is illustrated in FIG. 6.

Figure 8:
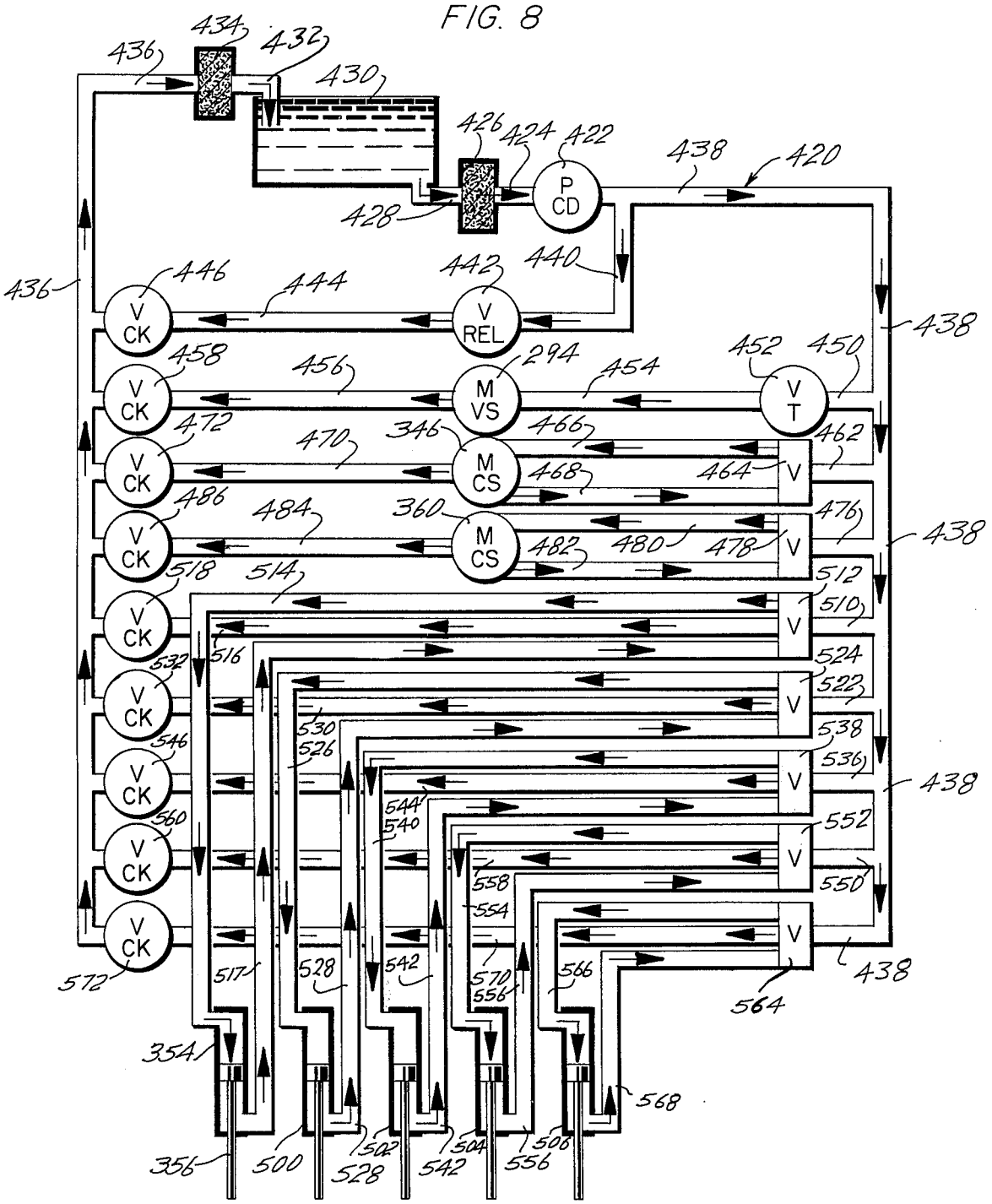
FIG. 8 is a schematic illustration of the hydraulic unit for operating this processing unit; and, FIG. 9 is a fragmentary view illustrating the rotors and shredders mounted on a lowboy for being pulled behind a tractor means so as to be able to be moved on highways and roads and to meet the legal requirements for being moved on such highways.

In FIG. 8 there is a schematic illustration of the hydraulic system 420. The hydraulic system comprises the pump 422. In FIG. 2 there is illustrated the pump 422. In FIG. 9 there is illustrated the pump 422. In FIG. 1 the pump 422 is connected to the power take-off unit 218 and is powered by the power take-off unit 218. The pump 422 connects with inlet line 424. The inlet line 424 connects with the filter 426. The filter connects with the outlet line 428 of the hydraulic fluid reservoir 430. An inlet line 432 connects with the hydraulic fluid reservoir 430. A filter 434 connects with the inlet line 432. A return line 436 connects with the filter 434.

The pump 422 connects with an outlet line 438. The outlet line 438 branches into a line 440 which connects with a relief valve 442. The relief valve 442 connects with a line 444. In the line 444 there is a check valve 446. The line 444 after the check valve connects with the return line 436.

The line 438 branches into a line 450. The line 450 connects with a hydraulic throttle valve 452. The valve 452 connects with a line 454. The line 454 connects with the screw conveyor motor 294. The motor 294 connects with a line 456 which in turn connects with the check valve 458. The check valve 458 connects with the return line 436.

The line 438 branches into a line 462. The line 462 connects with a hydraulic control valve 464. The hydraulic control valve 464 has an outlet line 466 which connects with the motor 346 for rotating the housing 304 or the blower plenium. The motor 346 has a return line 468 for connecting with the hydraulic control valve 464. The motor 346 has an outlet line 470 for connecting with the check valve 472. The check valve 472 connects with the return line 436.

The line 438 branches into a line 476. The line 476 connects with a hydraulic control valve 478. The hydraulic control valve has an outlet line 480 and which line 480 connects with the blower extension drive motor 360. The motor 360 has a return line 482 for connecting with the valve 478. The motor 360 has an outlet line 484 which connects with the check valve 486. The check valve 486 connects with the return line 436.

Figure 3:
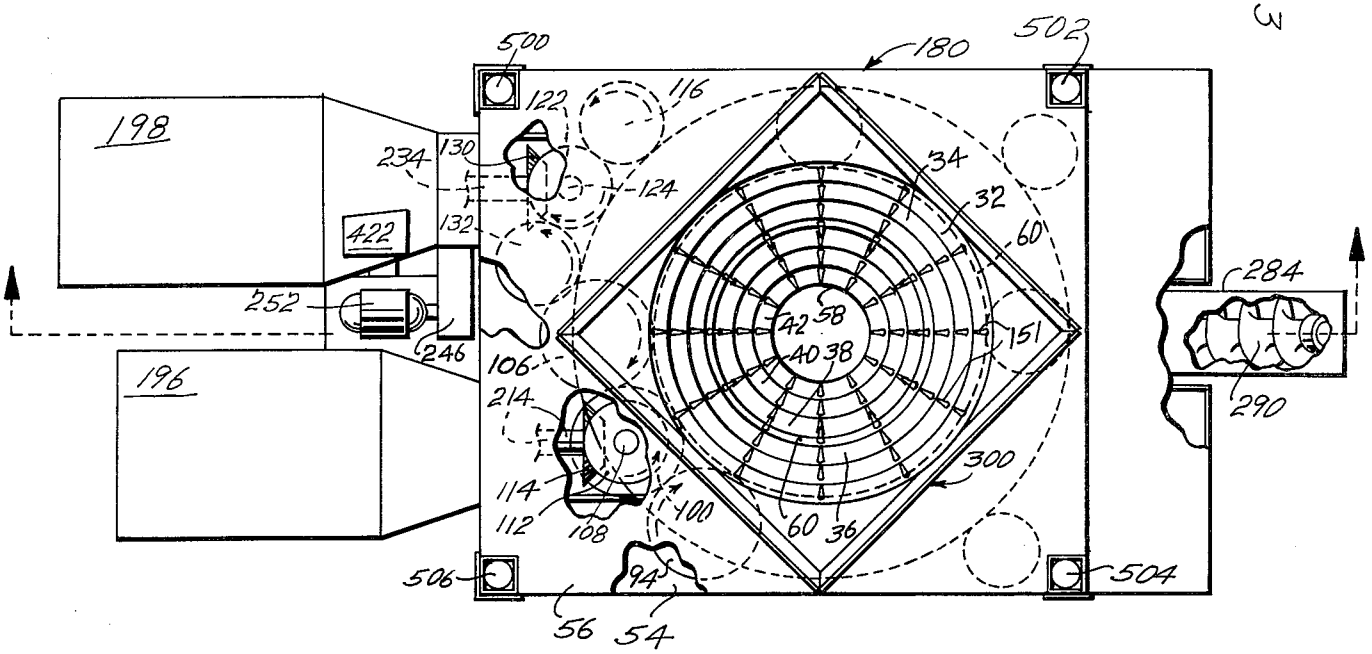
FIG. 3 is a plan view looking down on the processing unit and into the rotors and the shredders located below the rotors.

In FIG. 3 there are illustrated four leveling hydraulic rams 500, 502, 504 and 506 at the four corners of the unit 180 for leveling the entire machine for ease of operation. These same leveling hydraulic jacks 500, 502, 504 and 506 are used on the wood processing apparatus 400 of FIG. 9.

The line 438 branches into a line 510. The line 510 connects with a hydraulic cylinder control valve 512. The valve 512 has an outlet line 514 which connects with the hydraulic ram 354 having a plunger 356. The hydraulic ram 354 has an outlet line 517 which connects with the valve 512. The valve 512 also has an outlet line 516 which connects with a check valve 518. The check valve 518 connects with the return line 436.

The line 438 branches into a line 522. The line 522 connects with a hydraulic control valve 524. The valve 524 has an outlet line 526 which connects with the hydraulic cylinder or hydraulic ram 500. The hydraulic ram 500 has a return line 528 which connects with the valve 524. The valve 524 has a line 520 which connects with the check valve 532. The check valve 532 connects with the return line 436.

The line 438 branches into a line 536 which connects with the valve 538. The valve 538 connects with the line 540. The line 540 connects with the hydraulic leveling cylinder 502 or the hydraulic leveling ram 502. The hydraulic leveling ram 502 connects with the return line 542 which connects with the control valve 538. The control valve 538 has an outlet line 544 which connects with the check valve 546. The check valves 546 connects with the return line 436.

The line 438 branches into a line 550 which connects with the hydraulic control valve 552. The hydraulic control valve 552 connects with a line 554. The line 554 connects with the hydraulic leveling cylinder 504 and a hydraulic leveling ram 504. The ram 504 has the return line 556 which connects with the valve 552. The valve 552 has an outlet line 558 which connects with the check valve 560. The check valve 560 connects with the return line 436.

The line 438 connects with the hydraulic control valve 564. The hydraulic control valve 564 has an outlet line 566 which connects with the hydraulic leveling ram 506 or the hydraulic leveling cylinder 506. The ram 506 has a return line 568 which connects with the valve 564. The valve 564 has an outlet line 570 which connects with the check valve 572. The check valve 572 connects with the return line 436.

From the foregoing it is seen that there has been described the hydraulic system for actuating the motor 294 for driving the screw conveyor 288 and the screw conveyor 290. Also, the hydraulic system drives the motor 346 for rotating the blower housing 304 or the blower plenium 304. In addition, the hydraulic system actuates the ram 354 for elevating the blower housing 336. In addition, the hydraulic system actuates the motor 360 for telescoping the housings 340 and 334 with respect to each other for elevating the height of the conveyor 336.

From the foregoing it is seen that we have provided a method and an apparatus for taking a waste material such as logs, stumps, branches and the like and acting on these wood articles to make a fibrous wood article. The wood article is torn, shredded, crushed and divided to produce the fibrous wood article 170. The wood article is not chipped in this dividing and separating action but the wood article is mechanically divided into the fibrous wood article. As a result of this division, and the smaller size of the product it is possible to spread the fibrous wood article on the earth or ground to provide a mulch or fertilizer for the growing of trees. Or the fibrous wood article may be used in the manufacture of hardboard or wood pulp. Further, in the production of the fibrous wood article 170 and the disposal of the wood article such as stumps and logs it is not necessary to resort to the burning of the wood article and the consequent air and ground pollution. Further, it is less expensive to make the fibrous wood article 170 than it is to burn the raw wood article.

In the dividing and the separating of the wood article to make the fibrous shredded product 170 the wood is subjected to the substantially simultaneous action of two rotors with teeth rotating in opposite directions and also the successive action of two rotors with teeth rotating in opposite directions. Further, there is the shredding action of two rollers with teeth rotating in the same direction but rotating at different angular velocities acting on the wood to make the shredded fibrous product 170.

Having presented our invention what we claim is:

1. A process for reducing the size of an object, said process comprising:

a. contacting said object with a rotating abrasive means to divide said object into smaller pieces of said object;

b. introducing said object to an abrasive means having through passageway so that said object is reduced in size to pass through said passageway;

c. introducing said object to a first rotating abrasive means having a through passageway; and, d. introducing said object after leaving said first rotating abrasive means to a second rotating abrasive means having a through passageway.

2. A process for reducing the size of an object, said process comprising:

a. contacting said object with a rotating abrasive means to divide said object into smaller pieces of said object; and, b. shredding said smaller objects by passing said smaller objects between two abrasive rolls.

3. A process for reducing the size of an object, said process comprising:

a. contacting said object with a rotating abrasive means to divide said object into smaller pieces of said object; and, b. shredding said smaller objects by passing said smaller objects between two abrasive rolls having a rotational speed difference.

4. A process for reducing the size of wood, said process comprising:

a. tearing said wood by contacting said wood with a rotating abrasive means to divide said wood into smaller pieces of said wood;

b. introducing said wood to a first rotating abrasive means having a through passageway so that said wood passes substantially through the central portion of said first rotating abrasive means; and, c. introducing said wood after leaving said first rotating means to a second rotating abrasive means having a through passageway so that said wood passes substantially through the central portion of said second rotating means.

5. A process according to claim 4, said process comprising:

a. rotating said first rotating abrasive means and said second rotating abrasive means at different velocities.

6. A process according to claim 4, said process comprising:

a. shredding said smaller pieces of wood by passing said smaller objects between two abrasive rolls having a rotational speed difference.

7. A process according to claim 4, said process comprising:

a. rotating said first rotating abrasive means and said second rotating abrasive means in different directions.

8. A process for reducing the size of wood, said process comprising:

a. tearing said wood by contacting said wood with a rotating abrasive means to divide said wood into smaller pieces of said wood;

b. introducing said wood to said abrasive means having a through passageway so that said wood passes substantially through the central portion of said first rotating abrasive means; and, c. while introducing said wood to a first rotating abrasive means substantially simultaneously introducing said wood to a second rotating abrasive means having a through passageway so that said wood passes substantially through the central portion of said second rotating abrasive means.

9. A process according to claim 8, said process comprising:

a. rotating said first rotating abrasive means and said second rotating abrasive means at different velocities.

10. A process according to claim 8 and comprising:

a. rotating said first rotating abrasive means and said second rotating abrasive means in different directions.

11. A process according to claim 8 and comprising:

a shredding said smaller pieces of wood by passing said smaller objects between two abrasive rolls having a rotational speed difference.

12. A process for making a fibrous wood article, said process comprising:

a. subjecting a piece of wood to a simultaneous first tearing and dividing action and a second tearing and dividing action to produce said fibrous wood article; and, b. said first tearing and dividing action and said second tearing and dividing action acting in substantially the same direction on said piece of wood.

13. A process for making a fibrous wood article, said process comprising:

a. substantially simultaneously subjecting a piece of wood to a first tearing and dividing action and to a second tearing and dividing action; to produce a first fibrous wood article;

b. said first tearing and dividing action and second tearing and dividing action acting in different directions on said piece of wood;
c. subjecting said first fibrous wood article to a simultaneous third tearing and dividing action and a fourth tearing and dividing action to produce a second fibrous wood article; and,
d. said third tearing and dividing action and said fourth tearing and dividing action acting in substantially the same direction on said piece of wood.

14. A fibrous wood product prepared by the process comprising:
a. substantially simultaneously subjecting a piece of wood to a first tearing and dividing action and to a second tearing and dividing action; to produce a first fibrous wood article;
b. said first tearing and dividing action and said second tearing and dividing action acting in different directions on said piece of wood;
c. subjecting said first fibrous wood article to a simultaneous third tearing and dividing action and a fourth tearing and dividing action to produce a second fibrous wood article; and,
d. said third tearing and dividing action and said fourth tearing and dividing action acting in substantially the same direction on said piece of wood.

15. A fibrous wood article prepared by the process comprising:
a. a first tearing and dividing action on said wood by contacting said wood with a first rotating abrasive means to divide said wood;
b. a second tearing and dividing action on said wood by contacting said wood with a second rotating abrasive means to divide said wood;
c. said first tearing and dividing action and said second tearing and dividing action acting in different directions on said piece of wood; and
d. after said wood leaves said second tearing and dividing action on said wood shredding said wood by passing said wood between two abrasive rolls having a rotational speed difference.

16. A processing unit for reducing the size of an object, said unit comprising:
a. a first rotor having a first passageway;
b. a first abrasive means on the inside surface of said first passageway for dividing said object into smaller pieces of said object;
c. a means for rotating said first rotor;
d. a second rotor having a second passageway;
e. a second abrasive means on the inside surface of said second passageway for dividing said object into smaller pieces of said object;
f. said first passageway and said second passageway being in alignment for transferring said object between said first rotor and said second rotor; and,
g. a means for rotating said second rotor.

17. A processing unit according to claim 16 and comprising:
a. said first rotor and second rotor rotating at different velocities.
b. after said wood leaves said first rotating means shredding said wood by passing said wood between two abrasive rolls having a rotational speed difference.

18. A processing unit for reducing the size of wood, said unit comprising:
a. a first rotor having a first passageway;
b. a plurality of inwardly directed teeth on the inside surface of said first passageway for contacting said wood for tearing said wood into smaller pieces of wood;
c. a means for rotating said first rotor;
d. said processing unit comprising a mobile base having a plurality of ground engaging traction means;
e. said means for rotating said first rotor comprising a prime mover and a gear train between said prime mover and said first rotor; and
f. said ground engaging traction means comprising wheels.

19. A processing unit for reducing the size of wood, said unit comprising:
a. a first rotor having a first passageway;
b. a plurality of inwardly directed teeth on the inside surface of said first passageway for contracting said wood for tearing said wood into small pieces of wood;
c. a means for rotating said first rotor;
d. a second rotor having a second passageway;
e. a plurality of inwardly directed teeth on the inside surface of said second passageway for contracting said wood for tearing said wood into smaller pieces of wood;
f. said first passageway and said second passageway being in alignment for transferring said object between said first rotor and said second rotor;
g. a means for rotating said second rotor;
h. said means for rotating said first rotor comprising a prime mover and a first ring gear on said first rotor;
i. a gear train between said prime mover and said first ring gear;
j. said means for rotating said second rotor comprising a prime mover and a second ring gear on said second rotor;
k. a gear train between said prime mover and said second ring gear;
l. on the outlet end of the first passageway of said first rotor there being a first shredder and a second shredder for still further dividing said smaller pieces of said object;
m. said first shredder comprising a roller having an abrasive means on its exterior surface;
n. said second shredder comprising a roller having an abrasive means on its exterior surface; and,
o. said first shredder and said second shredder being mounted on substantially parallel shafts.

20. A processing unit for reducing the size of an object, said unit comprising:
a. a first rotor having a first passageway;
b. a first abrasive means on the inside surface of said first passageway for dividing said object into smaller pieces of said object;
c. a means for rotating said first rotor;
d. a second rotor having a second passageway;
e. a second abrasive means on the inside surface of said second passageway for dividing said object into smaller pieces of said object;
f. said first passageway and said second passageway being in alignment for transferring said object between said first rotor and said second rotor;

g. a means for rotating said second rotor; and,
h. said first rotor and said second rotor rotating in diferent directions.

21. A processing unit for reducing the size of wood, said unit comprising:
a. a first rotor having a first passageway;
b. a plurality of inwardly directed teeth on the inside surface of said first passageway for contacting said wood for tearing said wood into smaller pieces of wood;
c. a means for rotating said first rotor;
d. a second rotor having a second passageway;
e. a plurality of inwardly directed teeth on the inside surface of said second passageway for contacting said wood for tearing said wood into smaller pieces of wood;
f. said first passageway and said second passageway being in alignment for transferring said object between said first rotor and said second rotor; and,
g. a means for rotating said second rotor.

22. A processing unit according to claim 21 and comprising:
a. said first rotor and said second rotor rotating at different velocities.

23. A processing unit according to claim 21 and comprising:
a. said first rotor and said second rotor rotating in different directions.

24. A processing unit according to claim 21 and comprising:
a. said means for rotating said first rotor comprising a prime mover and a first ring gear on said first rotor;
b. a gear train between said prime mover and said first ring gear;
c. said means for rotating said second rotor comprising a prime mover and second ring gear on said second rotor; and,
d. a gear train between said prime mover and said second ring gear.

25. A processing unit according to claim 24 and comprising:
a. on the outlet end of the first passageway of said first rotor there being a first shredder and a second shredder for still further dividing said smaller pieces of said object.

26. A processing unit according to claim 25 and comprising:
a. a conveying means positioned with respect to the outlet of said first shredder and said second shredder for conveying away said pieces of wood.

27. A processing unit according to claim 26 and comprising:
a. said conveying means leading to a separating means for separating said pieces of wood from extraneous material.

28. A processing unit according to claim 25 and comprising:
a. said first shredder comprising a roller having an abrasive means on its exterior surface;
b. said second shredder comprising a roller having an abrasive means on its exterior surface;
c. said first shredder and said second shredder being mounted on substantially parallel shafts; and,
d. means for rotating said first shredder and said second shredder at different velocities.

* * * * *